US006174611B1

(12) United States Patent
Owatari et al.

(10) Patent No.: US 6,174,611 B1
(45) **Date of Patent: *Jan. 16, 2001**

(54) RECORDING MEDIUM AND INK JET RECORDING METHOD

(75) Inventors: Akio Owatari; Hiroyuki Onishi; Junichi Iida, all of Suwa; Yukio Kobayashi; Yoshihiro Kuroyama, both of Tokyo-To; Hiroki Midorikawa, Shirakawa, all of (JP)

(73) Assignees: Seiko Epson Corporation; Nippon Paper Industries, Co., both of Tokyo-To (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/634,782

(22) Filed: Apr. 19, 1996

(30) Foreign Application Priority Data

Apr. 25, 1995 (JP) ..... 7-101406

(51) Int. Cl.[7] ..... B41M 5/00; B41J 2/01

(52) U.S. Cl. ..... 428/521; 347/105; 428/195; 428/522; 428/532; 428/500; 428/478.2; 428/331

(58) Field of Search ..... 428/195, 521, 428/520, 337, 522, 532, 500, 478.2, 331; 106/31.27, 31.43, 31.51, 31.52; 347/105

(56) References Cited

U.S. PATENT DOCUMENTS

| | | | | |
|---|---|---|---|---|
| 4,395,287 | | 7/1983 | Kobayashi et al. | 106/20 |
| 5,185,213 | * | 2/1993 | Fujita et al. | 428/195 |

FOREIGN PATENT DOCUMENTS

| | | |
|---|---|---|
| 0487350 | 5/1992 | (EP) . |
| 0529308 | 3/1993 | (EP) . |
| 0634285 | 1/1995 | (EP) . |
| 2045645 | 11/1980 | (GB) . |

* cited by examiner

*Primary Examiner*—Pamela R. Schwartz
(74) *Attorney, Agent, or Firm*—Ladas & Parry

(57) ABSTRACT

A recording medium and a recording method are provided which can realize an image having excellent storage stability. An ink composition comprising a colorant of at least one dye selected from the group consisting of a stilbene azo dye, a triphenylmethane dye, and a xanthene dye is used, and the recording medium having a recording layer comprising silica and a binder, wherein the binder comprises a polymer component, 5 to 55% by weight of a polymer component of the binder is a styrene/butadiene latex, and 20 to 45% by weight of the styrene/butadiene latex is derived from a butadiene monomer.

15 Claims, No Drawings

RECORDING MEDIUM AND INK JET RECORDING METHOD

BACKGROUND OF THE INVENTION

1. Field of the Invention

The present invention relates to a recording medium and a recording method which can realize an image having excellent storage stability. More particularly, the present invention relates to an ink jet recording method which can realize an image having excellent storage stability and a recording medium suitable for the ink jet recording method.

2. Background Art

In an ink jet recording process, small droplets of an ink are ejected through various mechanisms and deposited on a recording medium to form ink dots. The ink jet recording process has advantages such as emission of no significant noise, high-speed printing, and ease of full color printing.

The storage stability of prints is an important property also for the ink jet recording method. A dye which is an organic material is generally used as a colorant in an ink composition for the ink jet recording method. Therefore, exposure of the dye to ultraviolet light or a highly active gas causes a possibility that the dye is decomposed resulting in a change in color tone. On the other hand, a recording medium carrying silica is used in the ink jet recording method. The silica has high specific surface area with a catalytic activity which may catalyze the oxidation of the dye.

Several methods for improving the storage stability of an image have been proposed. For example, Japanese Patent Laid-Open No. 87989/1982 discloses that the addition of a metal oxide, a metal chloride, or tannic acid to a recording layer results in improved light fastness in storage. Further, the addition of materials considered to be an antioxidant to a recording layer has been proposed. For example, Japanese Patent Laid-Open No. 61887/1986 discloses the addition of a polyallylamine derivative, Japanese Patent Laid-Open No. 146591/1986 discloses the addition of a hindered amine compound, Japanese Patent Laid-Open No. 154989/1986 discloses the addition of a hydrazide compound, and Japanese Patent Laid-Open No. 163886/1986 discloses the addition of a thiourea derivative, a thiosemicarbazide derivative, and a thiocarbohydrazide derivative.

On the other hand, some dyes have poor storage stability. In particular, dyes which, even when placed in an environment not directly exposed to light, undergo discoloration with the elapse of time are known in the art. Such dyes are considered to be decomposed by an oxidizing gas present in the air, for example, ozone.

SUMMARY OF THE INVENTION

We have now found that a combination of a recording medium having a specific composition with a dye which has been said to have poor storage stability can offer improved storage stability of an image.

Accordingly, an object of the present invention is to provide a recording medium, especially an ink jet recording medium, which can realize excellent storage stability of an image.

Another object of the present invention is to provide a recording method, especially an ink jet recording method, which can realize excellent storage stability of an image.

One aspect of the present invention provides a recording medium having a layer comprising silica and a binder, wherein the binder comprises a polymer component, 5 to 55% by weight of a polymer component of the binder is a styrene/butadiene latex, and 20 to 45% by weight of the styrene/butadiene latex is derived from a butadiene monomer.

Another aspect of the present invention provides a ink recording method comprising the step of carrying out recording on the above recording medium using an ink composition comprising a colorant of at least one dye selected from the group consisting of a stilbene azo dye, a triphenylmethane dye, and a xanthene dye.

A further aspect of the present invention provides an ink jet recording method comprising the step of ejecting droplets of an ink composition onto a recording medium to form ink dots on the recording medium, wherein the ink composition comprising a colorant of at least one dye is selected from the group consisting of a stilbene azo dye, a triphenylmethane dye, and a xanthene dye, wherein the recording medium is the above recording medium of the present invention.

DETAILED DESCRIPTION OF THE INVENTION

The recording medium according to the present invention has, preferably as a surface layer, a recording layer comprising silica and a binder. In the present invention, 5 to 55% by weight of a polymer component of the binder is a styrene/butadiene latex, and 20 to 45% by weight of the styrene/butadiene latex is derived from a butadiene monomer. Although components are primarily charged according to these proportions as a binder composition in the preparation method described below, they coincide with the proportions in % by weight of components constituting the polymer component of the binder in the dried recording layer in a final recording medium.

In the present invention, the presence of the specific styrene/butadiene latex as part of the binder in the recording layer can improve the storage stability of an image. In particular, a combination of the specific styrene/butadiene latex with a specific dye described below can realize marked improvement in storage stability of an image. While there is no intention of being bound by any particular theory, it is believed that the improvement in storage stability of an image is derived from the interaction between the dye in the ink composition and the binder in the recording layer. In particular, when the butadiene component content is high, two or more butadiene components are adjacent to each other or one another after polymerization and a plurality of aliphatic double bonds having a relatively high reactivity are possessed contributing to an deterioration in storage stability of an image.

Preferably, a water-soluble polymer is added as a component other than the styrene/butadiene latex of the binder. Preferred examples thereof include starches such as oxidized starch and esterified starch; cellulose derivatives such as carboxymethyl cellulose and hydroxyethyl cellulose; polyvinyl alcohol and derivatives thereof; polyvinyl pyrrolidone; casein; and gelatin. Among them, polyvinyl alcohol is particularly preferred.

Further, other components commonly used in binders may be added to the binder of the present invention. Specific examples of such components include aqueous resins such as a (meth)acrylate emulsion, a styrene/(meth)acrylate emulsion, and a vinyl acetate emulsion.

Silica as a pigment is incorporated into the recording layer of the recording medium according to the present invention.

The silica is preferably synthetic silica, and examples thereof include synthetic silica such as noncrystalline silica and amorphous silica. In addition, silica gel, white carbon, and anhydrous silica described in Kagaku Binran: Ohyo Kagaku Hen (published on Oct. 15, 1986 by Maruzen Co., Ltd., edited by The Chemical Society of Japan), infra p. 256 may be preferably used. Among them, white carbon is particularly preferred.

While the ratio of the binder to the silica may be suitably determined, the ratio of the binder to the silica in the recording layer is preferably about 0.1 to 1, more preferably about 0.2 to 0.8.

The recording medium according to the present invention can be prepared by preparing a coating composition comprising the silica and the binder and coating the coating composition onto a substrate for a recording medium, for example, paper. The coating composition may be prepared by mixing the silica, the binder, and water together while stirring. The amounts of the silica and the binder may be determined depending on the composition of the final recording layer. In this context, consideration is preferably given to satisfactorily binding the silica to the substrate and, at the same time, preventing the destruction of a porous structure necessary for ink absorption. In addition, if necessary, pigment dispersants, water retaining agents, thickeners, antifoaming agents, preservatives, colorants, hydration preventives, wetting agents, fluorescent dyes, ultraviolet absorbers, cationic polymer electrolytes and the like may be added to the coating composition.

The amount of the coating composition on the substrate for a recording medium may be properly determined so as to form a recording layer which can realize improved storage stability of an image. It is preferably 10 to 25 g/m$^2$ on a solid basis, more preferably 13 to 22 g/m$^2$ on a solid basis. The coating composition may be coated by any coating method properly selected from coating methods using known coaters, such as a blade coater, an air knife coater, a roll coater, a kiss coater, a squeeze coater, a curtain coater, a bar coater, a gravure coater, and a Komma coater.

According to a preferred embodiment of the present invention, an image, formed on the receiving medium, using an ink composition comprising at least one dye as a colorant selected from the group consisting of a stilbene azo dye, a triphenylmethane dye, and a xanthene dye has markedly improved storage stability.

Specific examples of these dyes include those represented by the following formulae (I), (II), (III), or (IV).

(I)

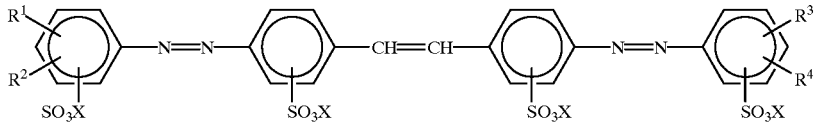

(II)

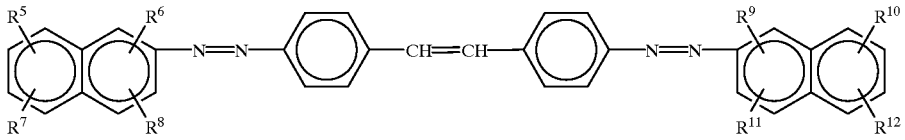

(III)

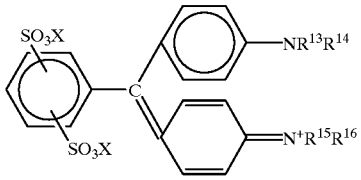

(IV)

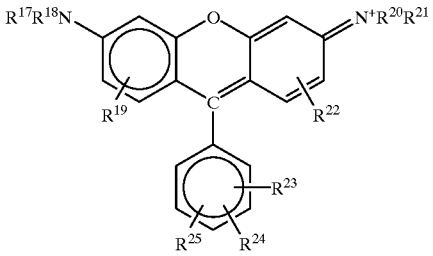

wherein X represents a cation, $R^1$ and $R^2$, and $R^3$ and $R^4$ each independently represent a hydrogen atom, a hydroxyl group, a lower alkyl group, a lower alkoxy group, a group —COOX wherein X is as defined above, or a group —$SO_3X$ wherein X is as defined above, $R^5$, $R^6$, $R^7$, and $R^8$, and $R^9$, $R^{10}$, $R^{11}$, and $R^{12}$ each independently represent a hydrogen atom, a hydroxyl group, an amino group, or a group —$SO_3X$ wherein X is as defined above, $R^{13}$ $R^{14}$, $R^{15}$, and $R^{16}$ each independently represent a hydrogen atom, a lower alkyl group, or an unsubstituted or substituted phenyl lower alkyl group, $R^{17}$, $R^{18}$, and $R^{19}$ each independently represent a hydrogen atom or a lower alkyl group, $R^{20}$ and $R^{21}$ each independently represent a hydrogen atom, a lower alkyl group, or a phenyl lower alkyl group, $R^{22}$ represents a hydrogen atom or a lower alkyl group, and $R^{23}$, $R^{24}$, and $R^{25}$ represent a hydrogen atom, a halogen atom, a group —COOX wherein X is as defined above, or a group —$SO_3X$ wherein X is as defined above.

In the above formulae, the lower alkyl group as the group or part of the group refers to a straight-chain or branched $C_{1-6}$ alkyl group, preferably $C_{1-4}$ alkyl group.

In the formulae, the cationic represented by X is preferably an alkali metal or an alkaline earth metal. The halogen atom may be any of fluorine, chlorine, bromine, and iodine. At least one hydrogen atom on the phenyl group in the phenyl lower alkyl group represented by $R^{13}$, $R^{14}$, $R^{15}$, and $R^{16}$ may be substituted with a group —$SO_3X$, wherein X is as defined above, or a group —$SO_3NH_4X$ wherein X is as defined above.

Preferred examples of the dyes represented by the above general formulae include the following dyes (A-1) to (A-6), (B-1) to (B-4), and (C-1) to (C-5).

(A-1)

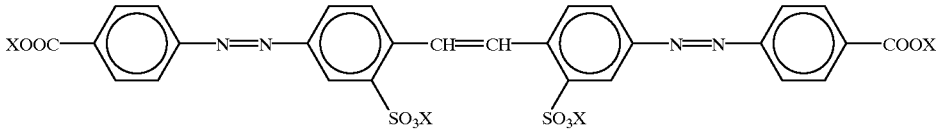

(A-2)

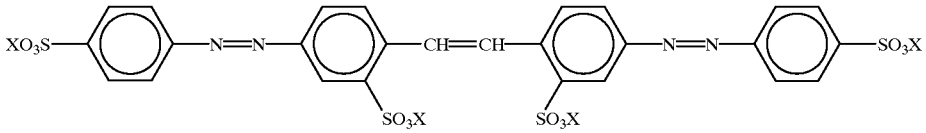

(A-3)

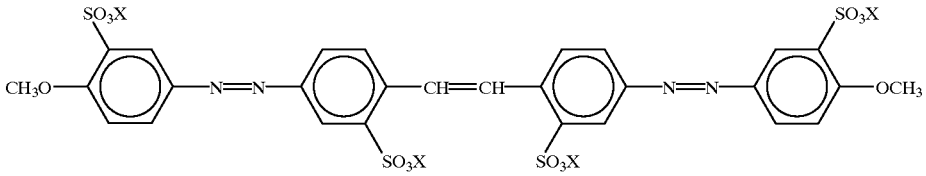

(A-4)

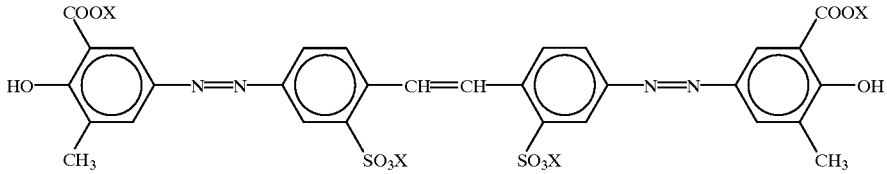

(A-5)

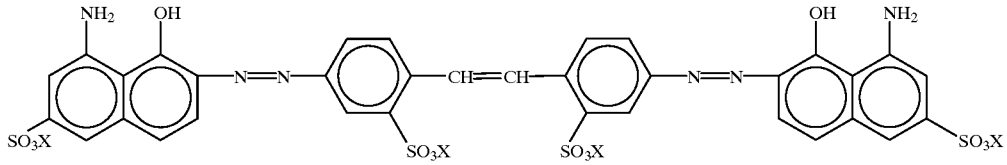

(A-6)

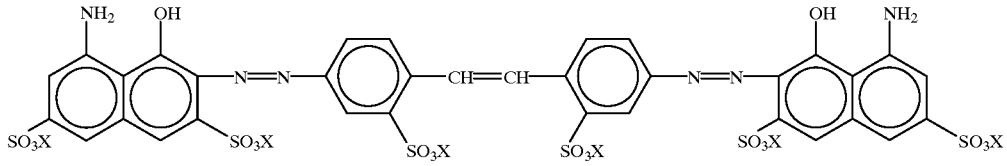

(B-1)

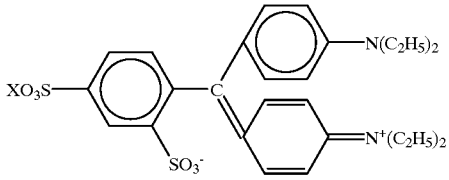

(B-2)

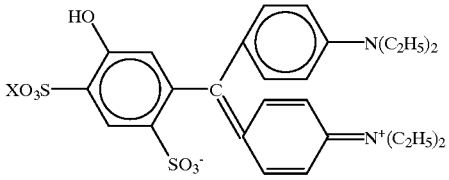

-continued (B-3)

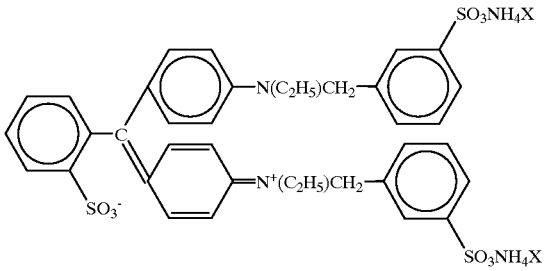

(B-4)

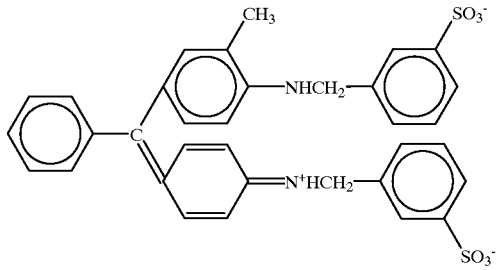

(C-1)

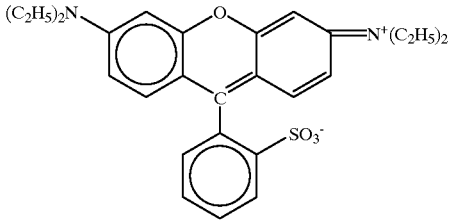

(C-2)

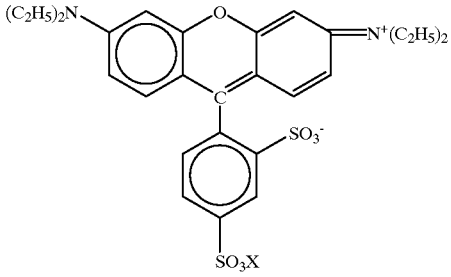

(C-3)

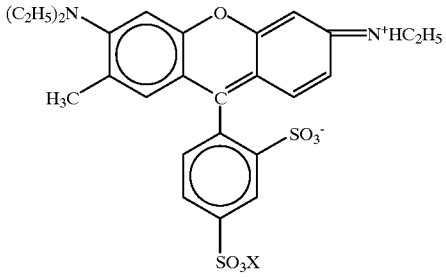

(C-4)

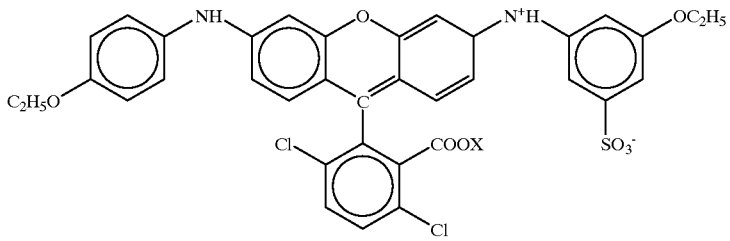

(C-5)

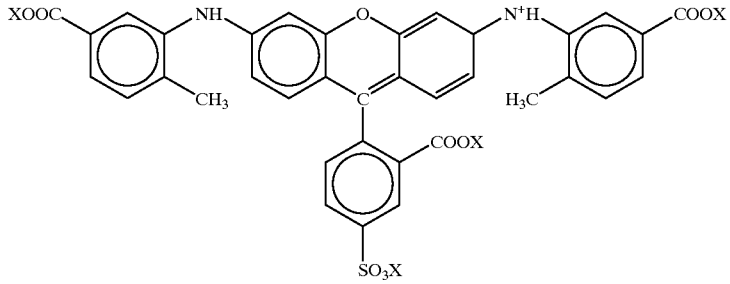

The ink composition used in the present invention may contain, in addition to the dye, components which are suitable for the ink composition of an ink recording method. For example, components which are suitable for the ink composition of an ink jet recording method may be preferably used for the ink composition of the present invention.

In particular, the ink composition for ink jet recording may basically comprises, in addition to a colorant, an organic solvent and water. Preferred examples of the organic solvent include high-boiling, low-volatile polyhydric alcohols such as glycerin, ethylene glycol, diethylene glycol, triethylene glycol, propylene glycol, dipropylene glycol, hexylene glycol, polyethylene glycol, and polypropylene glycol. Further, water-soluble organic solvents, e.g., nitrogen-containing organic solvents, such as N-methyl-2-pyrrolidone, 1,3-dimethylimidazolidinone, monoethanolamine, N,N-dimethylethanolamine, N,N-diethylethanolamine, diethanolamine, N-n-butyldiethanolamine, triisopropanolamine, and triethanolamine, may be added in such an amount as will cause neither bleeding nor feathering. Diethylene glycol and glycerin are especially preferred. The addition of benzotriazole is preferred from the viewpoint of stabilizing the properties of the ink composition.

EXAMPLE

The present invention will now be described in more detail with reference to the following examples, though it is not limited to these examples only. Preparation Production of styrene/butadiene latex An autoclave type polymerization reactor was charged with 100 parts by weight of ion-exchanged water, 2 parts by weight of sodium dodecylbenzenesulfonate, 0.1 part by weight of dodecylmercaptan, and 0.5 part by weight of ammonium persulfate, and the mixture was thoroughly stirred. Thereafter, each monomer listed in Table 1 was added thereto, and polymerization was initiated at 65° C. The polymerization was terminated when the conversion reached 98%. Subsequently, the copolymer latex was adjusted to pH 7 by the addition of aqueous ammonia. Thus, styrene/butadiene latexes (SBR) A to E listed in Table 1 were prepared.

TABLE 1

| SBR | Butadiene parts by weight | Styrene parts by weight | Acrylic acid parts by weight |
|---|---|---|---|
| A | 25 | 72 | 3 |
| B | 30 | 67 | 3 |
| C | 35 | 62 | 3 |
| D | 40 | 57 | 3 |
| E | 50 | 47 | 3 |

Example A1

Hardwood Bleached Sulfate Pulp (c.s.f 300 ml)(85 parts by weight), 15 parts by weight of precipitated calcium carbonate, 0.02 part by weight of an internally added sizing agent (an alkyl ketene dimer), 1.0 part by weight of aluminum sulfate, and 0.5 part by weight of a cationized starch were mixed together. Thereafter, a Fourdrinier machine was used to make a base paper having a basis weight of 80 g/m$^2$.

On the other hand, synthetic silica (FINESIL X-37, manufactured by TOKUYAMA Corp.) was dispersed in an amount of 100 parts by weight in 340 parts by weight of water. The resultant dispersion was mixed with a binder solution of 10 parts by weight of the styrene/butadiene latex A prepared above and 40 parts by weight of polyvinyl alcohol (PVA105, manufactured by Kuraray Co., Ltd.) dissolved in 350 parts by weight of water, and a bluing dye and a fluorescent dye were added thereto, thereby preparing a coating composition.

The coating composition was coated on the base paper by roll coating, and the coating was then dried to prepare an ink jet recording paper. The amount of the coating on the paper was 14 g/m$^2$.

Example A2

An ink jet recording paper was prepared in the same manner as in Example A1, except that the styrene/butadiene latex B was used in an amount of 20 parts by weight, the polyvinyl alcohol was used in an amount of 30 parts by weight, and the amount of the coating on the paper was 17 g/m$^2$.

Example A3

An ink jet recording paper was prepared in the same manner as in Example A1, except that the styrene/butadiene latex C was used.

Example A4

An ink jet recording paper was prepared in the same manner as in Example A3, except that the styrene/butadiene latex D was used in an amount of 15 parts by weight, the polyvinyl alcohol was used in an amount of 35 parts by weight, and the amount of the coating on the paper was 21 g/m$^2$.

Comparative Example A1

An ink jet recording paper was prepared in the same manner as in Example A1, except that no styrene/butadiene latex was added and the amount of the coating on the paper was 17 g/m$^2$.

Comparative Example A2

An ink jet recording paper was prepared in the same manner as in Example A1, except that the styrene/butadiene latex E was used and the amount of the coating on the paper was 21 g/m$^2$.

Comparative Example A3

An ink jet recording paper was prepared in the same manner as in Example A3, except that the styrene/butadiene latex C was used in an amount of 30 parts by weight, the polyvinyl alcohol was used in an amount of 20 parts by weight, and the amount of the coating on the paper was 17 g/m$^2$.

Comparative Example A4

An ink jet recording paper was prepared in the same manner as in Comparative Example A1, except that 0.5 part by weight of tannic acid was added as an antioxidant to the coating composition of Comparative Example A1.

Example B

Ink compositions listed in Table 2 were prepared. The dye Nos. in the table correspond to those as described above.

TABLE 2

| | Example | | | |
|---|---|---|---|---|
| | B1 | B2 | B3 | B4 |
| Dye | | | | |
| (A-4) Na salt | | 1 | | |
| (A-6) Li salt | 3 | | | |
| (B-3) Na salt | | | 2 | |
| (C-2) Na salt | | | | 2.5 |
| Diethylene glycol | 15 | 7 | 10 | |
| Glycerin | | | | 15 |
| Diethylene glycol monobutyl ether | 10 | 8 | 10 | |
| Surfynol 485 | | 0.5 | 0.5 | 2 |
| Water | 72 | 83.5 | 77.5 | 80.5 |

Evaluation tests

The storage stability of images recorded on the recording media were evaluated as follows.

MACHJET PRINTER MJ-500C (manufactured by Seiko Epson Corporation) was used to carry out solid printing (100% duty) of ink compositions of Examples Bl to B4.

Print density

The print density was measured with a Macbeth densitometer RD-514 for five points for each color print. The results were averaged. The average value was evaluated as follows. Print density: exceeding 1.2 . . . ○1.1 to 1.2 . . . Δ less than 1.1 . . . X Storage stability The prints were placed in a hermetically sealed vessel in which an ozone concentration was 30 ppm and, 5 min after the prints were placed in the vessel, taken out of the vessel. Evaluation was carried out according to the following criteria.

(a) Discoloration at printed area
1. Substantially no discoloration observed . . . ○
2. Somewhat discoloration observed . . . Δ
3. Remarkable discoloration observed . . . x (b) Yellowing at white area of paper
1. Substantially no yellowing observed . . . ○
2. Somewhat yellowing observed . . . Δ
3. Remarkable yellowing observed . . . x The results were as given in Table 3.

TABLE 3

| | SBR content in binder | Butadiene content in SBR | Coating amount | Print density/(a) evaluation of discoloration at image area Example | | | | (b) Yellowing at white area |
|---|---|---|---|---|---|---|---|---|
| | (wt %) | (wt %) | (g/m$^2$) | B1 | B2 | B3 | B4 | of paper |
| Ex. A1 | 10 | 25 | 14 | ○/○ | ○/○ | ○/○ | ○/○ | ○ |
| Ex. A2 | 50 | 30 | 17 | ○/○ | ○/○ | ○/○ | ○/○ | ○ |
| Ex. A3 | 20 | 35 | 14 | ○/○ | ○/○ | ○/○ | ○/○ | ○ |
| Ex. A4 | 30 | 40 | 21 | ○/○ | ○/○ | ○/○ | ○/○ | ○ |
| Comp. Ex. A1 | 0 | — | 17 | ○/Δ | ○/Δ | ○/X | ○/X | X |
| Comp. Ex. A2 | 20 | 50 | 21 | Δ/X | Δ/Δ | Δ/X | ○/X | ○ |
| Comp. Ex. A3 | 60 | 35 | 17 | X/○ | X/○ | X/○ | X/○ | ○ |
| Comp. Ex. A4 | 0 | — | 17 | X/Δ | X/Δ | X/Δ | Δ/Δ | X |

What is claimed is:

1. An ink jet recording medium comprising a substrate and a recording layer on the substrate, said recording layer comprising silica and a binder, wherein the binder is formed from a polymer component comprising a styrene/butadiene copolymer and a water-soluble polymer which is selected from the group consisting of a starch, a cellulose derivative, polyvinyl alcohol and derivatives thereof, polyvinyl pyrrolidone, casein and gelatin, the ratio of the styrene/butadiene copolymer to the water-soluble polymer being 5:95 to 55:45 by weight, wherein 20 to 45% by weight of the styrene/butadiene copolymer is derived from a butadiene monomer.

2. The recording medium according to claim 1, wherin the water-soluble polymer is polyvinyl alcohol.

3. The recording medium according to claim 1, wherein the recording layer is a surface layer.

4. The recording medium according to claim 1, wherein the recording layer further comprises a cationic polymer.

5. A kit comprising the recording medium according to claim 1 and an ink composition that is ejectable as droplets onto the recording medium.

6. The kit according to claim 5, wherein the ink composition comprises a colorant, an organic solvent and water.

7. The kit according to claim 6, wherein the colorant is an ink composition comprising a colorant of at least one dye selected from the group consisting of a stilbene azo dye, a triphenylmethane dye, and a xanthene dye.

8. The kit according to claim 7, wherein the colorant is represented by the formula (I), (II), (III), or (IV):

(I)

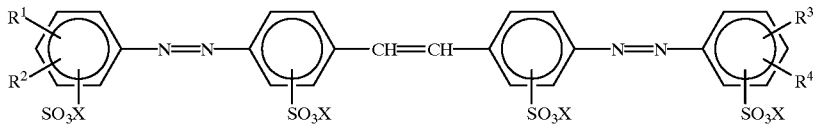

(II)

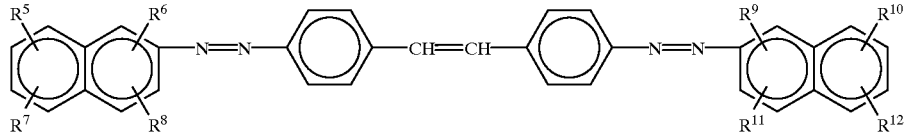

-continued (III)

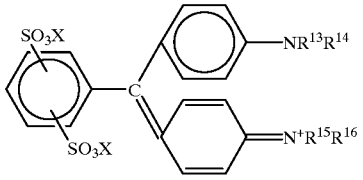

(IV)

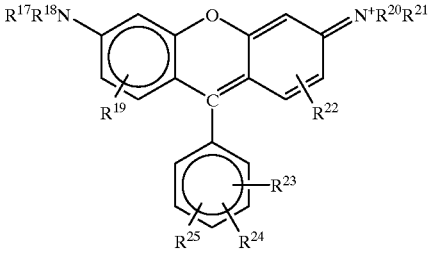

wherein X represents a cation, $R^1$ and $R^2$, and $R^3$ and $R^4$ each independently represent hydrogen, hydroxyl, lower alkyl, lower alkoxy, a group —COOX wherein X is as defined above, or a group —$SO_3X$ wherein X is as defined above, $R^5$, $R^6$, $R^7$, and $R^8$, and $R^9$, $R^{10}$, $R^{11}$, and $R^{12}$ each independently represent hydrogen, hydroxyl, amino, or a group —$SO_3X$ wherein X is as defined above, $R^{13}$, $R^{14}$, $R^{15}$, and $R^{16}$ each independently represent hydrogen, lower alkyl, or unsubstituted or substituted phenyl lower alkyl, $R^{17}$, $R^{18}$, and $R^{19}$ each independently represent hydrogen or lower alkyl, $R^{20}$ and $R^{21}$ each independently represent hydrogen, lower alkyl, or phenyl lower alkyl, $R^{22}$ represents hydrogen or lower alkyl, and $R^{23}$, $R^{24}$, and $R^{25}$ represent hydrogen, halogen, a group —COOX wherein X is as defined above, or a group —$SO_3X$ wherein X is as defined above.

9. The kit according to claim 5, wherein the water-soluble polymer is polyvinyl alcohol.

10. The kit according to claim 9, wherein the polymeric component consists essentially of the styrene/butadiene copolymer, the water-soluble polymer and an acrylic resin.

11. The kit according to claim 5, wherein the ink composition, when ejected as droplets onto the recording medium, can form a print having a print density exceeding 1.2.

12. A recording method comprising carrying out recording on a recording medium according to claim 1 with an ink composition comprising a colorant of at least one dye selected from the group consisting of a stilbene azo dye, a triphenylmethane dye, and a xanthene dye.

13. An ink jet recording medium comprising a substrate and a recording layer on the substrate, said recording layer being formed by (a) mixing silica, water and a plurality of binder components, including a styrene/butadiene copolymer, a water soluble polymer and a resin emulsion, to form an aqueous mixture, (b) coating the, substrate with the aqueous mixture to form a coating on the substrate; and drying the coating to form the recording layer; said recording layer comprising the silica and a binder formed from said binder components, said binder having a polymer content that is 5 to 55% by weight styrene/butadiene copolymer, 20 to 45% by weight of said styrene/butadiene copolymer being derived from a butadiene monomer.

14. An ink jet recording method comprising the step of ejecting droplets of an ink composition onto a recording medium to form ink dots on the recording medium, the ink composition comprising a colorant of at least one dye selected from the group consisting of a stilbene azo dye, a triphenylmethane dye, and a xanthene dye, the recording medium being one according to claim 13.

15. An ink jet recording medium comprising a substrate and a recording layer on the substrate, said recording layer comprising silica and a binder, said binder having a polymer content that consists essentially of (a) a styrene/butadiene copolymer; (b) a water soluble polymer selected from the group consisting of starch, a cellulose derivative, polyvinyl alcohol and derivatives thereof, polyvinyl pyrrolidone, casein and gelatin; and, optionally, (c) a resin that is emulsifiable in water to form an aqueous resin emulsion; 5 to 55% by weight of said polymer content being said styrene/butadiene copolymer, 20 to 45% by weight of said styrene/butadiene copolymer being derived from a butadiene monomer.

* * * * *